United States Patent [19]

Abrahams

[11] 4,155,183

[45] May 22, 1979

[54] PIN AND CLIP FASTENER

[76] Inventor: Norman Abrahams, 944 Cherry St., Philadelphia, Pa. 19107

[21] Appl. No.: 910,739

[22] Filed: May 30, 1978

[51] Int. Cl.[2] ..... A44C 3/00

[52] U.S. Cl. ..... 40/1.5; 24/3 D; 24/85 C

[58] Field of Search ..... 24/3 D, 3 H, 13, 85 C, 24/85 R, 86 C, 86 R; 40/1.5, 11 A, 13

[56] References Cited

U.S. PATENT DOCUMENTS

| | | | |
|---|---|---|---|
| 1,475,782 | 11/1923 | Beach | 40/1.5 |
| 2,155,987 | 4/1939 | Assaf | 24/85 C X |
| 2,449,539 | 9/1948 | Birdsell | 24/86 C X |
| 2,618,086 | 11/1952 | Komorous | 40/1.5 |
| 4,020,575 | 5/1977 | Kruger et al. | 40/1.5 |

FOREIGN PATENT DOCUMENTS

| | | | |
|---|---|---|---|
| 1329990 | 9/1973 | United Kingdom | 40/1.5 |

*Primary Examiner*—Philip C. Kannan
*Attorney, Agent, or Firm*—Zachary T. Wobensmith, 2nd; Zachary T. Wobensmith, III

[57] ABSTRACT

A combination pin and clip fastener is provided made of wire for optionally mounting on a garment or the like an object with which it is engaged, and which object may be a transparent plastic holder for an identification card, either by a securing pin engaged through the garment or by a resilient clip engaged with a pocket or a marginal edge of the garment.

8 Claims, 4 Drawing Figures

PIN AND CLIP FASTENER

BACKGROUND OF THE INVENTION

1. Field of the Invention

This invention relates to a combination pin and clip for optionally mounting on a garment or the like an object with which it is engaged.

2. Description of the Prior Art

It has been common practice to mount on a garment a transparent plastic holder containing an identification by a pin secured to the rear of the plastic holder. Some persons object to the use of such a pin because of possible injury to the garment. One such mounting is shown in the U.S. Pat. to Hudson et al, No. 942,326. The mountings heretofore proposed for this purpose frequently become spearated from the plastic holder or are not secure for other reasons.

In the U.S. Pat. to Wetherell, No. 323,759 a combined safety pin and clip of wire is disclosed, but this is not suitable for selective mounting on a garment.

The U.S. Pat. to Potts, No. 439,423 shows an umbrella or cane holder, formed of wire, and which includes a safety pin and article engaging arms but this also does not provide any selective mounting.

The U.S. Pat. to Braunger, No. 670,097 shows supports for flowers formed of wire, with different provisions for mounting the support including a vertical safety pin, a horizontal safety pin, a triangular clip, and a hair engaging pin. No selective mounting is available.

Tomkins in U.S. Design Pat. No. 30,131 shows a safety pin with a loop formed thereon.

None of the foregoing show a combination pin and clip, with the clip engaged with an article to be supported and also capable of providing a support for the article on a garment.

SUMMARY OF THE INVENTION

A combination safety pin and loop is provided for article support in which the loop is engaged with the article to be supported and is available selectively with the pin for article mounting on a garment.

It is the principal object of the invention to provide a combination safety pin and loop for article support which is simple in construction, but effective in its action.

It is a further object of the invention to provide an article support for badges and other articles which avoids injury to a garment on which it is mounted.

It is a further object of the invention to provide a pin and clip or loop of the character aforesaid which can be made of a single piece of wire.

Other objects and advantageous features of the invention will be apparent from the description and claims.

Brief Description of the Drawings

The nature and characteristic features of the invention will be more readily understood from the following description taken in connection with the accompanying drawings forming part hereof in which.

Figure 1:
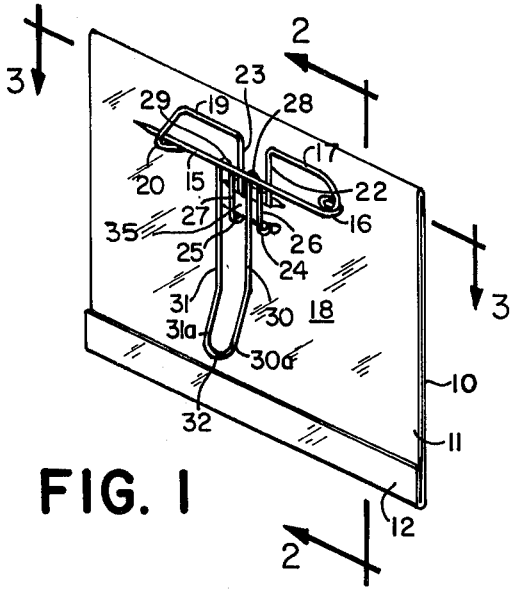
FIG. 1 is a rear perspective view of an article support in accordance with the invention supporting a transparent plastic identification card holder.
Figure 2:
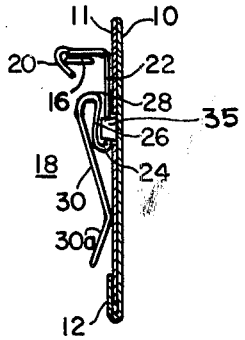
FIG. 2 is a vertical sectional view taken approximately on the line 2—2 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings the article to be supported is illustrated by way of example as a flat rectangular folder of one piece of transparent, synthetic plastic material with a front wall 10, a rear wall 11 and a rear rim 12 extending from the front face in overlapping relation to the rear face. Folders of this nature are in common use for holding identification cards and the like visible through the front wall 10. The article support 14 hereinafter described in detail is not limited to the specific use herein shown.

The article support 14, preferably made of a single piece of wire of sufficient resilience to have a spring action includes a pin arm 15 extending from one end of a spring coil 16, a horizontal arm 17 which extends from the other end of the spring coil 16 and to the clip, shown generally at 18, and from which a horizontal arm 19 extends with a rearwardly disposed hook 20 for engagement by the pin arm 15.

The clip 18 preferably has a pair of substantially parallel arm portions 22 and 23 extending downwardly at right angles respectively from the horizontal arm portions 17 and 19 and with bends or curved portions 24 and 25 connected to upwardly extending arm portions 26 and 27 which have curved forwardly disposed clip hinge portions 28 and 29 extending therefrom and from which downwardly extending clip arm portions 30 and 31 extend. The clip portions 30 and 31 are joined by a connecting portion 32. The clip arm portions 30 and 31 may have lower rearwardly inclined portions **30*a* and 31*a* to facilitate application of the clip 18** to the edge of a pocket or to an upper marginal portion of a garment.

In order to mount the clip 18 and the article support 14, of which it is a part, on the rear face 11, spaced upper and lower transverse slots 33 and 34 are provided with a band 35 therebetween.

The article support 14 can be assembled to the rear wall 11 by inserting the clip 18 through the upper slot 33, behind the band 35 and outwardly through the lower slot 34 so that arms 26 and 27 are below the band 35 and then moving the clip 28 upwardly to position the arms 26 and 27 in front of the band 35.

In this position of the article support 24, the structure is ready for use.

An identification card can be inserted between the walls 10 and 11, so as to be visible through the front wall 10.

Figure 3:
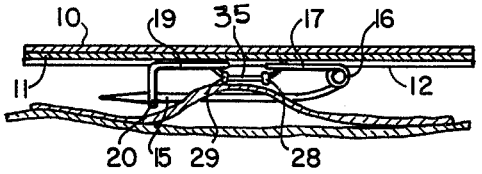
FIG. 3 is a horizontal sectional view taken on the line 3—3 of FIG. 1 and showing the pin employed for mounting.
Figure 4:
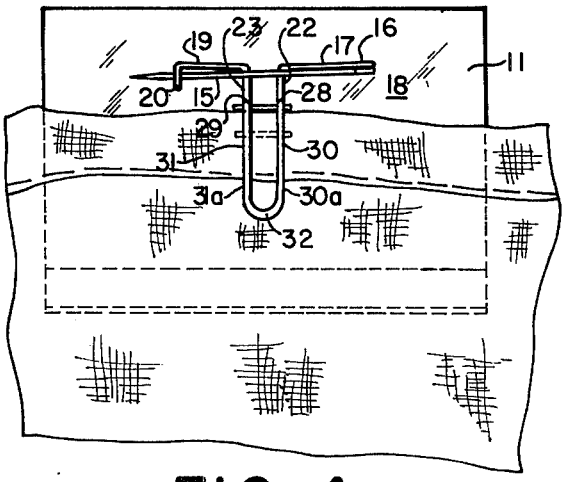
FIG. 4 is a rear elevational view of the article support shown in FIG. 1 and showing the engagement of the clip over the edge of a pocket.

If desired, the pin can be inserted the pin arm 15 can be pushed through the desired portion of a garment on which it is to be used and the pin arm 15 engaged and held by the hook 20, as shown in FIG. 3.

If it is not desired to insert the pin arm 15 through a garment the clip 28 can be slipped inwardly over an edge portion of a garment, which may be a pocket or other margin, where the arms 30 and 31 resiliently held by the spring hinge portions 28 and 29 will retain the article support 14 and the article carried thereby in place. The resiliency of the spring hinge portions 28 and 29 and the arm portions 30*a* and 31 will facilitate the application and the resiliency of the spring hinge portions 28 and 29 will aid in retaining the article in supported relation.

I claim:

1. A support for an article on clothing of the wearer comprising an article support member of wire having a swingable pin arm and a hook for engagement by the free end of said pin arm, said support member having an elongated clip portion intermediate the ends of the pin arm and extending substantially normal to said pin arm, said clip portion having a part for engagement with an article to be supported intermediate the top and bottom thereof and a downwardly extending part for disposition along the clothing.

2. A support as defined in claim 1 in which said hook is carried on a horizontal arm portion, said pin arm is horizontally disposed, another horizontal arm is provided on which said pin arm is carried, said other horizontal arm portion is aligned with said first mentioned horizontal arm portion, and said clip portion is interposed between and connected to said horizontal arm portions.

3. A support as defined in claim 2 in which said clip portion is hingedly mounted with respect to said horizontal arm portions.

4. A support as defined in claim 2 in which a spring is interposed between said pin arm and the horizontal arm portion to which it is connected.

5. A support as defined in claim 1 in which said clip portion has substantially parallel arms extending downwardly from said horizontal arm portions and connected at their lower ends.

6. A support as defined in claim 5 in which said clip portion intermediate the top and bottom thereof has hooked portions in said arms for article engagement.

7. A support for an article as defined in claim 1 in which an article to be supported is provided and said article has a wall portion with a horizontal band and slots above and below said band, and said clip portion extends through said slots and is in engagement with said band.

8. A support for an article as defined in claim 7 in which said clip portion is in engagement with an inner face of said band and has parts extending upwardly in front of said band.

* * * * *

UNITED STATES PATENT OFFICE

CERTIFICATE OF CORRECTION

Patent No. 4,155,183 Dated May 22, 1979

Inventor(s) Norman Abrahams

It is certified that error appears in the above-identified patent and that said Letters Patent are hereby corrected as shown below:

Column 2,

Line 53, after "clip", "28" should be - 18 - .

Line 55, after "support", "24" should be - 14 - .

Line 65, after "clip", "28" should be - 18 - .

Signed and Sealed this

*Twenty-first* Day of *August 1979*

[SEAL]

*Attest:*

*Attesting Officer*

LUTRELLE F. PARKER

*Acting Commissioner of Patents and Trademarks*